US009259110B2

(12) United States Patent
Garneau et al.

(10) Patent No.: US 9,259,110 B2
(45) Date of Patent: Feb. 16, 2016

(54) SPORT BOTTLE WITH CLOSING MECHANISM

(71) Applicant: LOUIS GARNEAU SPORTS INC., St-Augustin-de-Desmaures (CA)

(72) Inventors: Louis Garneau, Saint-Augustin-de-Desmaures (CA); Geoffroy Dussault, St-Augustin-de-Desmaures (CA)

(73) Assignee: LOUIS GARNEAU SPORTS INC. (CA)

( * ) Notice: Subject to any disclaimer, the term of this patent is extended or adjusted under 35 U.S.C. 154(b) by 0 days.

(21) Appl. No.: 14/048,429

(22) Filed: Oct. 8, 2013

(65) Prior Publication Data

US 2015/0097007 A1 Apr. 9, 2015

(51) Int. Cl.

| | |
|---|---|
| ***B65D 47/00*** | (2006.01) |
| ***B65D 47/12*** | (2006.01) |
| ***A47G 19/22*** | (2006.01) |
| ***B65D 47/28*** | (2006.01) |
| ***A45F 3/16*** | (2006.01) |
| *B05B 11/00* | (2006.01) |
| *B65D 47/26* | (2006.01) |
| *B67D 7/02* | (2010.01) |
| *B65D 47/20* | (2006.01) |

(52) U.S. Cl.

CPC ..... *A47G 19/2266* (2013.01); *A45F 3/16* (2013.01); *B65D 47/2031* (2013.01); *B65D 47/283* (2013.01); *B05B 11/3015* (2013.01); *B65D 47/121* (2013.01); *B65D 47/20* (2013.01); *B65D 47/26* (2013.01); *B67D 7/0294* (2013.01)

(58) Field of Classification Search

CPC ..... B65D 47/12; B65D 47/20; B65D 47/26; B65D 47/2018; B65D 47/2075; B65D 90/582; B65D 90/585; B65D 47/18; B65D 47/2031; B65D 47/283; B65D 47/121; B05B 11/3015; B67D 7/0297; A45F 3/16; A47G 19/2266; Y10T 137/86686

USPC ..... 222/505, 212–215, 490–491, 494, 544, 222/559, 564, 562, 528–529, 531–532, 222/566–568; 215/387–388; 220/703, 220/714–715, 705, 711

See application file for complete search history.

(56) References Cited

U.S. PATENT DOCUMENTS 1,356,837 A * 10/1920 Stegmaier ..... 222/92
2,472,555 A * 6/1949 Ward ..... 222/511

(Continued)

OTHER PUBLICATIONS

Canadian Office Action for corresponding application No. 2,829,830; Report Dated Mar. 31, 2015.

*Primary Examiner* — Frederick C Nicolas
(74) *Attorney, Agent, or Firm* — Cantor Colburn LLP

(57) ABSTRACT

A sport bottle defining a cavity with top open end to contain a liquid. A cap closes the cavity, the cap having a body with a spout. A conduit extends transversely through the cap and opened on opposed sides of a circumference of the body of the cap, the conduit being in fluid communication with the spout and having a passage in fluid communication with the cavity. A valve is formed of two pistons disposed onto a shaft, the pistons being sized to sealingly define with the conduit an interstitial space. The valve is displaceable by pressing the ends between a closed configuration in which the pistons block liquid from the cavity from entering the interstitial space, and a dispensing configuration in which the interstitial space is aligned with the passage and the spout to allow liquid from the cavity to reach the spout.

15 Claims, 5 Drawing Sheets

(56) References Cited

U.S. PATENT DOCUMENTS

| | | | | | |
|---|---|---|---|---|---|
| 3,146,913 | A * | 9/1964 | Kiyoshi | 222/110 |
| 4,026,442 | A * | 5/1977 | Orton | 222/181.3 |
| 4,095,727 | A * | 6/1978 | Dorsch | 222/400.8 |
| 4,271,986 | A * | 6/1981 | Stecker | 222/151 |
| 5,699,933 | A * | 12/1997 | Ho et al. | 220/703 |
| 6,523,711 | B1 * | 2/2003 | Hughes et al. | 220/709 |
| 6,896,161 | B2 * | 5/2005 | Patz | 222/484 |
| 8,302,823 | B2 * | 11/2012 | Lim | 222/495 |
| 8,397,940 | B2 * | 3/2013 | Steininger | 220/714 |
| 8,608,016 | B2 * | 12/2013 | Chiu et al. | 220/705 |
| 8,844,742 | B2 * | 9/2014 | Fujita et al. | 220/203.01 |
| 8,955,718 | B2 * | 2/2015 | Ciavarella et al. | 222/190 |
| 2008/0257884 | A1 | 10/2008 | Geberzahn | |

* cited by examiner

SPORT BOTTLE WITH CLOSING MECHANISM

TECHNICAL FIELD

This application relates generally to caps for liquid containers, and more particularly to a pour cap for liquid containers such as sports bottles.

BACKGROUND OF THE ART

Athletes engaged in sport activities have for a long time recognized the need to stay constantly hydrated. Liquid containers, such as sports bottles, provide an easily accessible liquid source for athletes and other persons engaged in various strenuous activities. Conventionally, sport bottles have had caps of multiple shapes and sizes that allow the athlete to gain easy access to the contents of the liquid container without fully removing the lid or the cap of the bottle, by way of valves of different type. There has also been an increasing trend in bottle design and innovation to adapt these bottles for greater integration with the athletes' activity and optimal ease of access to a hydration source without disturbing the activity substantially.

For pouring the liquid out of a conventional sports bottle, the cap can be screwed off, and the liquid poured out of the mouth of the bottle. Manually openable valves are also known, which can open the liquid conduit of the sports bottle by pulling on the valve mouthpiece with the fingers. In some instances, when the athlete's hands are occupied at other tasks, for instance maneuvering a bicycle, teeth or lips of the athlete may be used while the bottle is held in one hand. Further opening mechanisms requiring a certain level of dexterity or manipulations have also been explored, such as pop-out spouts which in most cases necessitate a firm grip on the bottle with one hand and another hand free for opening the spout.

However, these liquid release and sport bottle opening mechanisms can be inconvenient in many situations, particularly during strenuous activities such as cycling or running. If the cap is fully removed from a conventional sports bottle, the liquid is more likely to spill out of the bottle. Since the mouth of a conventional sports bottle has a relatively large diameter, the liquid is thus prone to fall out of the sides of the bottle and splatter onto a person's face and clothes.

Manually-actuated release mechanisms are also disadvantageous during some activities, in that they require both hands to be available, or in that the mouthpiece come in contact with the athlete's mouth, sometimes at high velocity. They can also sometimes be difficult to access properly without using the athlete's vision, causing him or her to disturb the activity to focus on the cap mechanism. Other liquid release and opening mechanisms requiring a greater degree of dexterity for manipulation also have the same limitations.

SUMMARY

It is an aim of the present disclosure to provide a sport bottle that addresses issues related to the prior art.

Therefore, in accordance with the present disclosure, there is provided a sport bottle comprising: a liquid container body defining a cavity with top open end, the cavity adapted to contain a liquid; a cap releasably connected to the container body to close the cavity, said cap having a body with a spout extending outwardly from the body, a conduit extending transversely through the cap and opened on opposed sides of a circumference of the body of the cap, the conduit being in fluid communication with the spout and having at least one passage in fluid communication with the cavity of the liquid container body; and a valve formed of at least two pistons disposed onto a shaft, said valve inserted into the conduit with ends of the valve projecting out of the opposite sides of the circumference of the body, the pistons being sized to sealingly define with the conduit an interstitial space, the valve displaceable by pressing the ends between a closed configuration in which the pistons block liquid from the cavity from entering the interstitial space in the conduit, and a dispensing configuration in which the interstitial space is aligned with the at least one passage and the spout to allow liquid from the cavity to enter the interstitial space in the conduit and reach the spout.

Reference will now be made to the exemplary embodiments illustrated, and specific language will be used herein to describe the same. It will nevertheless be understood that no limitation of the scope of the invention is thereby intended.

DETAILED DESCRIPTION

Figure 1:
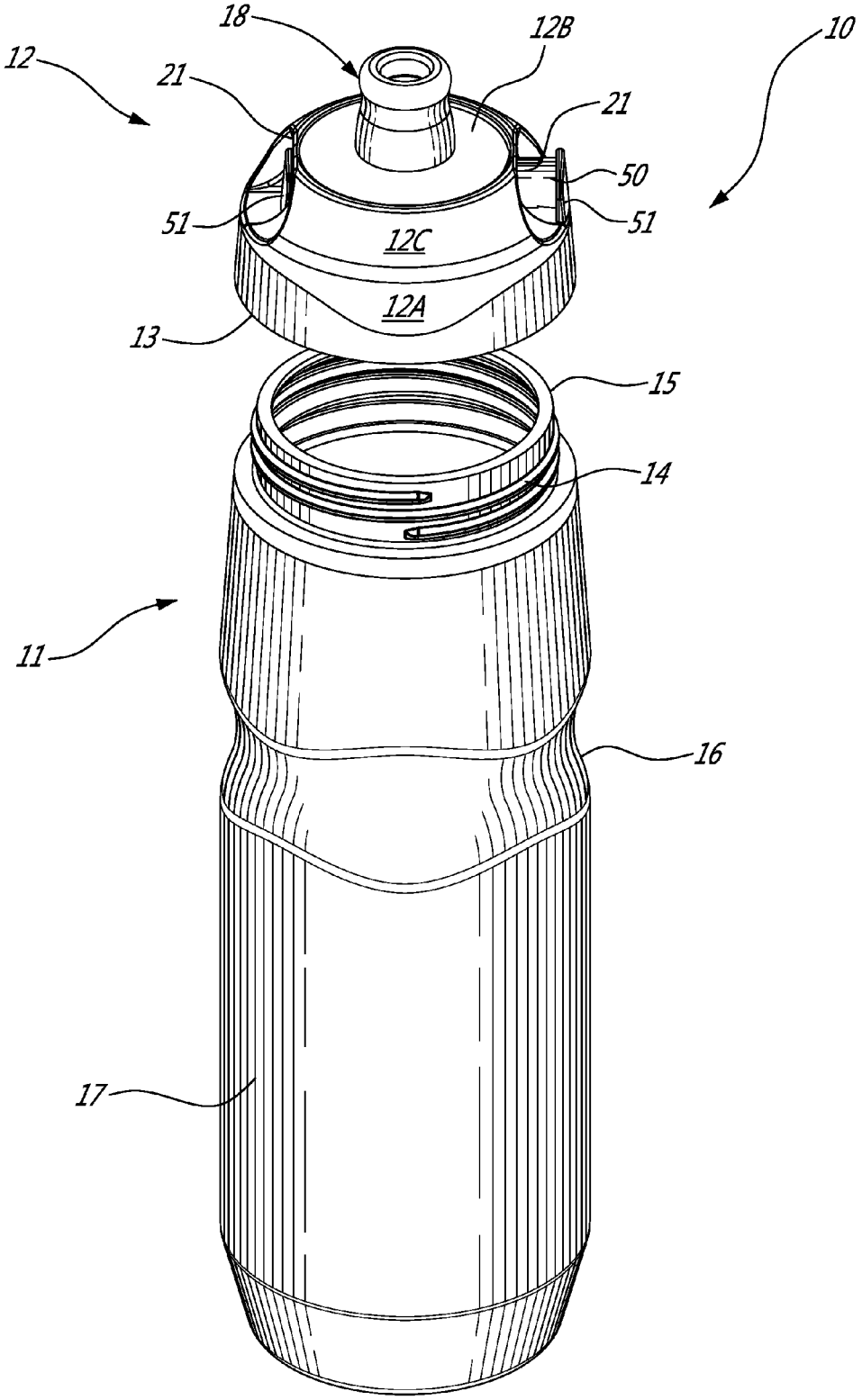
FIG. 1 is a perspective assembly view of a sport bottle with closing mechanism in accordance with the present disclosure.

Referring to the drawings and more particularly to FIG. 1, a sport bottle with closing mechanism 10 is generally shown comprising a container body 11 and a cap 12 containing a tapped connector 13 which can be screwed or otherwise attached to a threaded connector 14 on the exterior of a neck 15 of the container body 11. It is to be understood that the container body 11 and the threaded connector 14 can comprise a single piece having a unitary molded construction, while the cap 12 is constituted of numerous components.

The container body 11 is to be generally cylindrical in shape and having an outside diameter sized for handling by a user. In a preferred embodiment, the container body 11 can have a ridge 16 or otherwise a form of depression on a part of a sidewall 17 so that the bottle can be held captive more easily to a bottle rack of a bicycle or other connecting mechanism of sport equipment. The central region may for example be shaped to facilitate easier grasping of the sport bottle 10 by a user. It is within the scope of the present disclosure that other configurations may be utilized.

Figure 2:
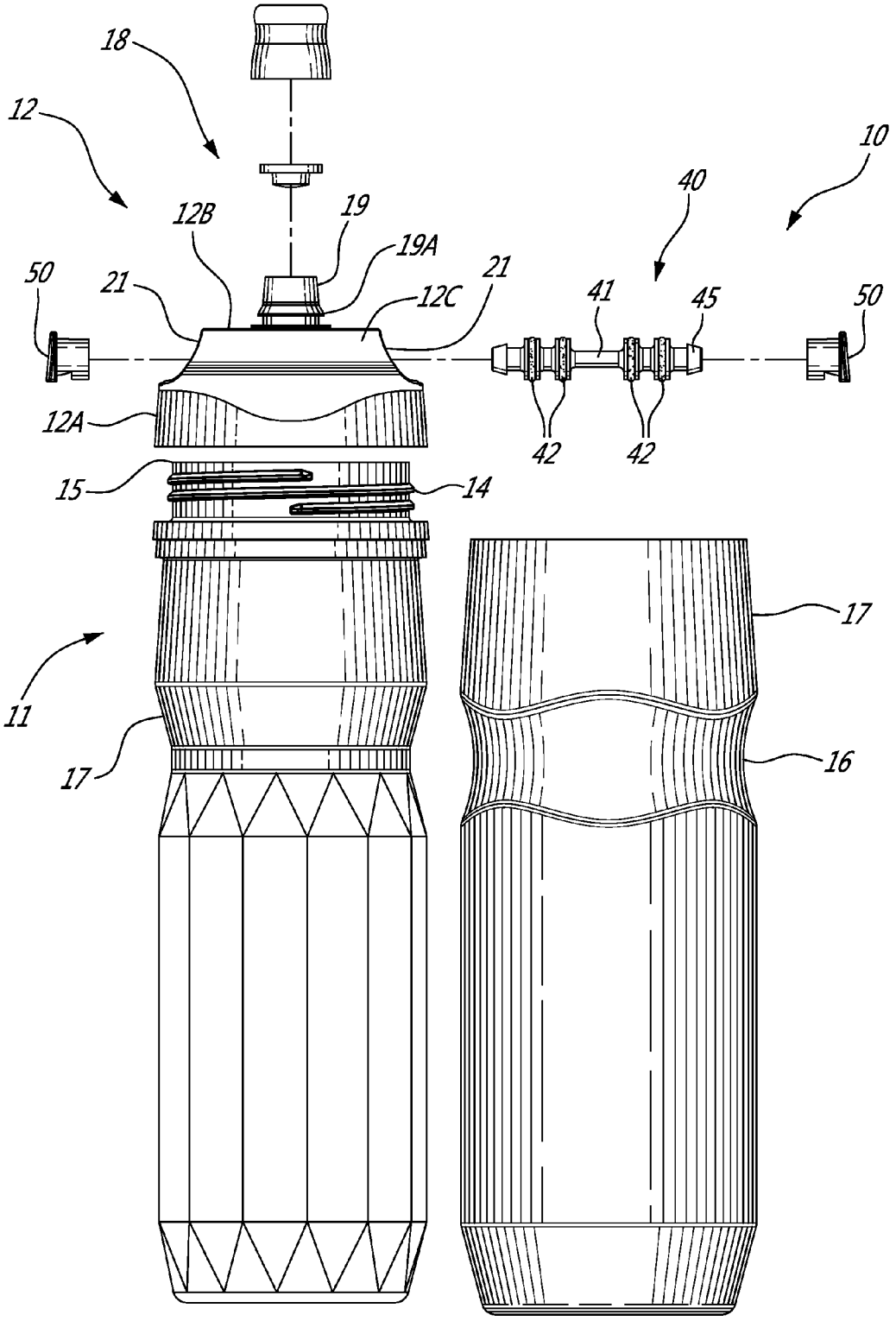
FIG. 2 is a side elevation assembly view of the sport bottle of FIG. 1.

The container body 11 can be formed from any suitable material or combination of materials. Illustrative examples of materials that may be used include polycarbonate, polyethylene, polypropylene, glass, metal, and the like. Some embodiments may require the materials to be translucent or semi-translucent so as to allow the athlete to see the remaining quantity of liquid in the bottle and in other embodiments, more rigid opaque materials can be favored. Moreover, it is considered to provide the container body 11 with an insulating layer embedded in its sidewall 17, or sandwiched between a pair of sidewalls, such as shown in FIG. 2, with an additional sidewall 17 that may be installed over the first sidewall 17

(having the threaded connector 14), with an insulating layer or thermal layer therebetween, such as aluminum foil reflecting light away.

The cap 12 is to be connected, and typically removably connected, to the neck 15 of the liquid container, by cooperation between the tapped connector 13 and the threaded connector 14. By "removably connected," it is meant that the cap assembly is designed, or adapted, to be repeatedly connected to and disconnected from the neck 15 of the container body 11 without deformity of the cap body 12 or the neck 15. When properly connected to the neck 15, the cap body 12 forms a seal with the neck 15 of the container body 11 and thereby selectively seals the internal compartment of the container to prevent or limit the liquid from being dispensed accidently through the junction between the container body 11 and the cap 12.

The cap 12 contains a body from which protrudes a spout 18 extending outward. In a preferred embodiment, the body has a tubular cylindrical base 12A of a cylindrical shape so as to be of a slightly larger diameter than the neck 15. A bottom of the base 12A is thus open, and a top is closed by a disk-like surface 12B. The spout 18 extends upward from the top of the cap body 12, i.e., from the disk-like panel 12B. A tapering frusto-conical like portion 12C is between the base 12A and the disk-like panel 12B. The closing mechanism is located in the frusto-conical like portion 12C, as will be described hereinafter.

Figure 3:
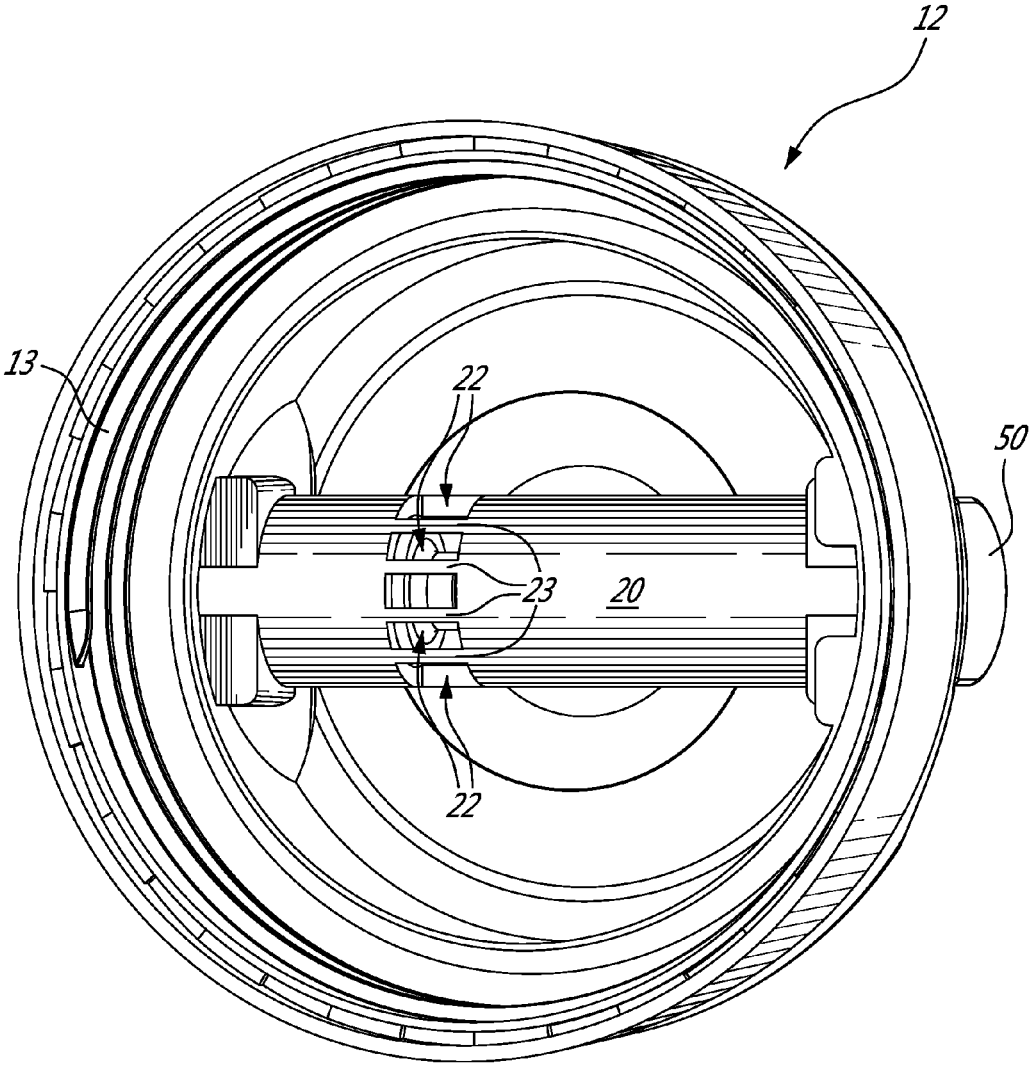
FIG. 3 is an underside view of a cap of the sport bottle of FIG. 1.
Figure 4:
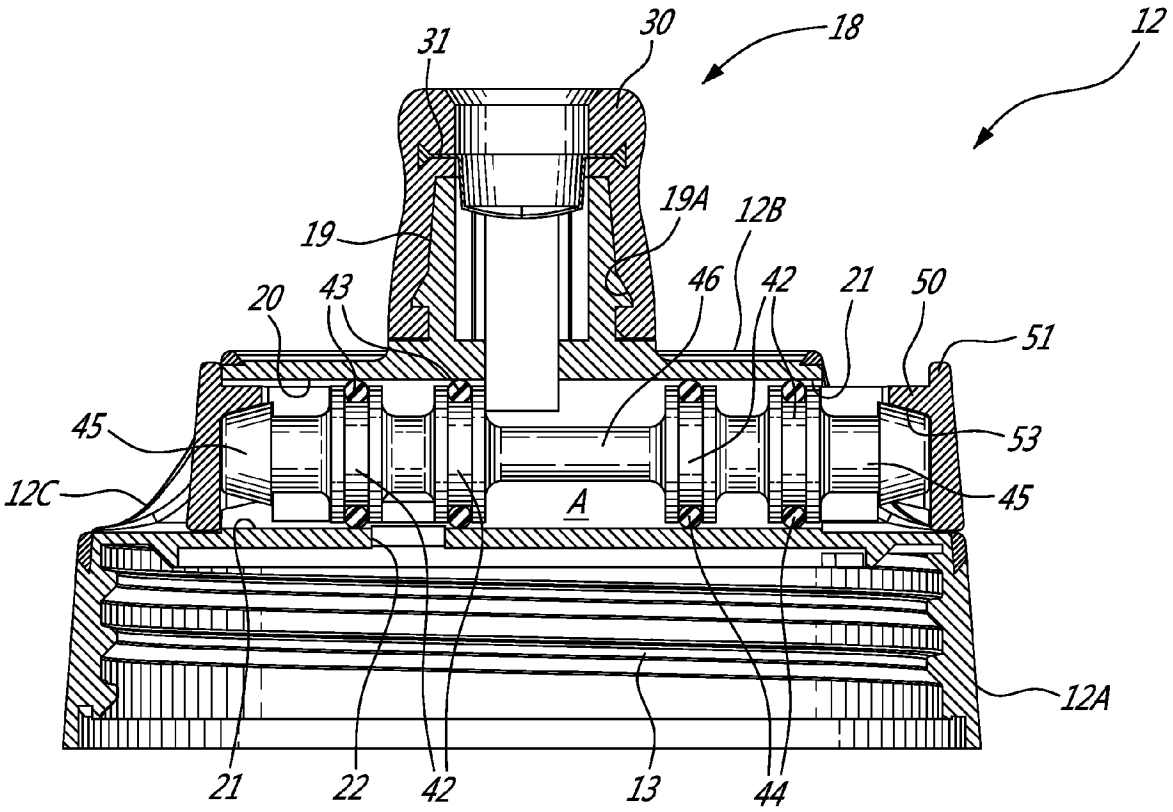
FIG. 4 is a partly sectioned view of the cap of FIG. 3, with a valve in a closed configuration.

Referring concurrently to FIGS. 2-4, the spout 18 is defined by an opening tube 19 that is integral with the body of the cap 12, the opening tube 19 having for instance a wedge ring 19A thereon. The opening tube 19 is hollow and in fluid communication with a conduit 20 defined in the frusto-conical like portion 12C. In the illustrated embodiment, the conduit 20 has a cylindrical shape, but other shapes are considered as well. The conduit 20 has openings 21 that are diametrically opposed on the body of the cap 12, with the openings 12 being defined in the sidewall of the frusto-conical like portion 12C. Hence, the conduit 20 is generally transverse relative to a vertical axis of the sport bottle 10.

Referring to FIG. 3, the conduit 20 has one or a multitude of passages 22, circumferentially distributed in the wall of the conduit 20, and hence delimited by one or many attachment members or webs 23 between the passages 22 of the cylindrical conduit 20. In a preferred embodiment, the attachment members 23 are the thin remaining parts of the cylindrical conduit 20 itself after is has been machined or molded to produce rectangle-shaped passages 22. These passages 22 will serve as a passageway for the liquid to enter an interstitial space A as described hereinafter. As the cap 12 is connected to the container body 11 during use, the passages 22 are open to a liquid cavity formed concurrently by the container body 11 and the cap 12. It is through the passages 22 that the liquid from the container body 11 will enter the conduit 20 to be expelled via the spout 18. Hence, in the illustrated embodiment, the circumferential distribution of the passages 22 maximizes the area of opening into the conduit 20, while not affecting the structural integrity of the conduit 20.

Referring to FIGS. 1, 2, 4 and 5, a perforated drink tip 30 is shown relative to the opening tube 19, as retained by the wedge ring 19A. The wedge ring 19A is thus used to fasten and prevent loose movement when the drink tip 30 is mounted onto the opening tube 19. The wedge arrangement thus enables the drink tip 30 to be deformed and removed only when such positive intentional action is imparted on it, and constitutes one of numerous arrangements that can be used to releasably secure a drink tip thereon. As an illustrative, non-exclusive example, the drink tip 30 should be made of rubber of some other resilient material. The drink tip 30 should also preferably be easily removable from the opening tube 19 so that it may be cleaned and replaced. It is also considered to leave the spout 18 with the opening tube 19 as the user interface, i.e., no drink tip 30. A valve 31 may be an additional accessory that reduces the risk of water leakage. The valve 31 is shown as removably installed in the drink tip 30, but may alternatively be in the opening tube 19, etc. The valve 31 may be a disk of a resilient material such as a silicone, with a slit. The pressure of water flow from toward the spout 18 will result in the opening of the valve 31.

The cap body 12 contains a closing mechanism comprising a valve 40 in the conduit 20, which the user can move along its longitudinal axis to configure the closing mechanism from a closed to a dispensing configuration. The valve 40 is comprised of a shaft 41 on which are positioned a number of pistons 42. In an embodiment, two sets of two pistons 42 are present on the shaft 41 with the same distance relative to each other and separated by a central portion 46. This symmetrical arrangement of two sets of two pistons 42 allows for the valve 40 to be replaced interchangeably without distinction from one side to the other, i.e., without a specific orientation. While the disclosure contemplates other piston arrangements, any symmetrical arrangement accomplishes the purpose of simplifying the task of replacing the valve 40 if it was removed for cleaning purposes. In an embodiment, the two sets of pistons 42 are to be closer to end heads 45 of the shaft 41 so as to define the central portion 46 which is larger than the distance of the outward piston 42 to the tip of their respective end head 45, as the central portion 46 will occupy a portion of the dispensing conduit 20 as will be described hereinafter, and thus reduce its volume. The pistons 42 may contain grooves 43 on which can be removably but firmly inserted seals such as O-rings 44 made of rubber or some other resilient sealing material. Alternatively, the pistons 42 could be molded in a material effecting the seal without the need for additional seals such as the O-rings 44. Without limiting the generality of the disclosure, the shaft 41 may be of a cylindrical shape of varying diameter and the pistons 42 may be round protuberances of a larger diameter. In an embodiment, the O-rings 44 are integrally molded and disposed about the outer surface of the pistons 42 into the grooves 43 of complementary shape.

Figure 5:
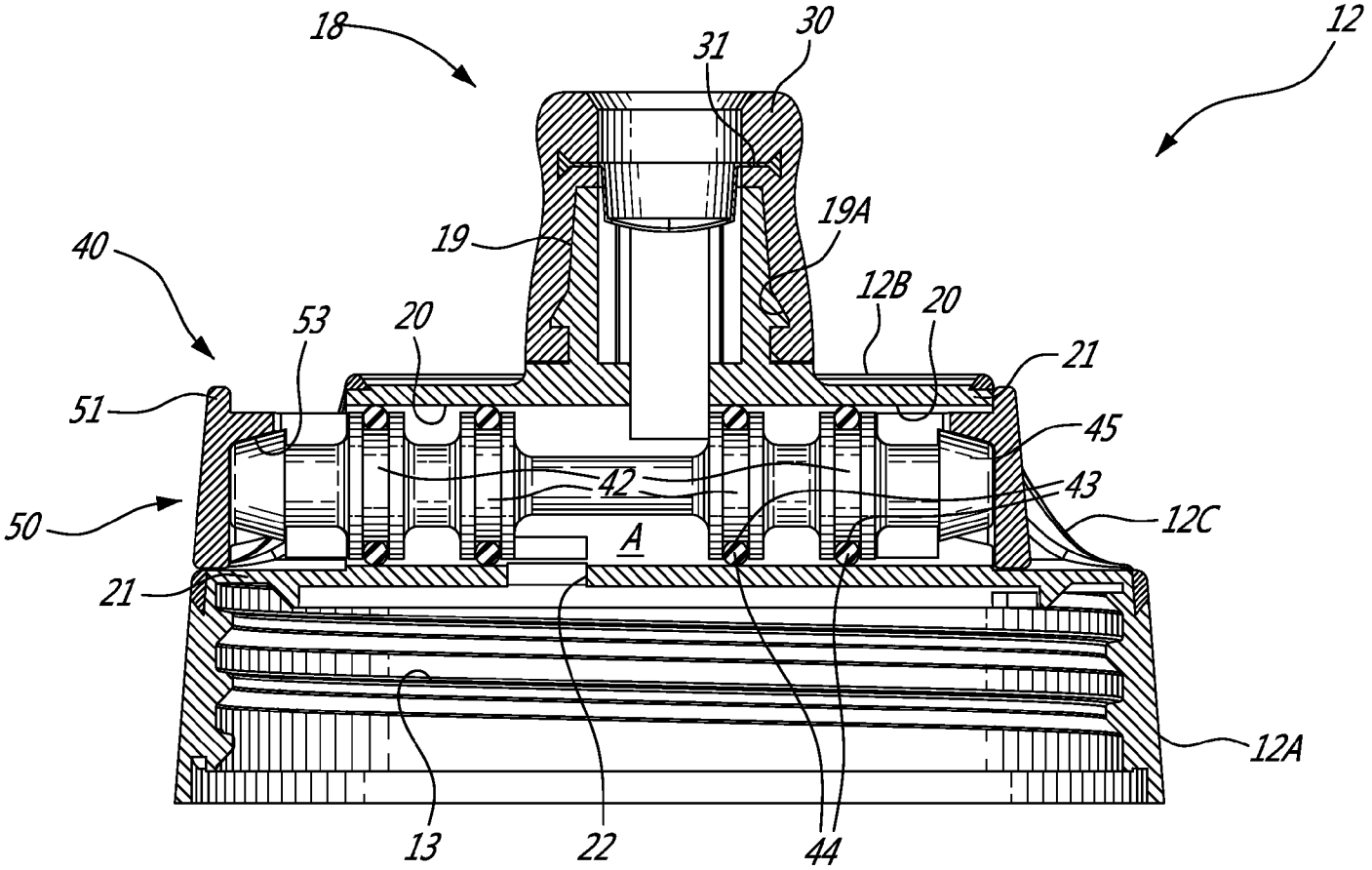
FIG. 5 is a partly sectioned view of the cap of FIG. 3, with the valve in a opened configuration.

Referring to FIGS. 4 and 5, the valve 40 is completed on both sides with the attachment of a tubular stopper 50 with a stop member 51 in the form of a flange or the like at its extremity, and an opening 53 in the stopper 50. The stopper 50 is to be removably connected to the head 45 at extremities of the shaft 41. The diameter of the opening 53 of the stopper 50 is to be slightly smaller than the tip of the head 45 so as to allow snug snap-fit fixation of the stopper 50 on the head 45, by way of a wedge ring on the heads 45 and complementary groove in the opening 53, or like arrangement. The stopper 50 may thus be removed to subsequently pull the valve 40 out of the conduit 20, for washing, etc. In an embodiment, the length of the stopper 50 from its base to the stop member 51 is of the same length as the tip of the head 45 to the outward piston 42. It may also be desired that the stop member 51 be of such a size and shape so as to seal the aperture of the cylindrical conduit 20 when the valve 40 is tilted to one side or the other. In such a case, the stop member 51 forms an additional seal to the O-rings 44.

The valve 40 must be so designed or manufactured so that the shaft 41, with protruding pistons 42 must fit when inserted into the cylindrical conduit 20 positioned transversally through the cap body 12. While this disclosure contemplates all possible dispositions of the cylindrical conduit 20, a preferred embodiment is a cylindrical shaped conduit disposed on the longitude of the cross-section of the cap body 12, hence opened at diametrically opposed sides of the base of the cap body 12.

Referring to concurrently to FIGS. 4 and 5, the interstitial space A is bound by the wall of the conduit 20, between the pistons 42 of the valve 40 when the valve 40 is inserted into the cylindrical conduit 20. In FIG. 4, the valve 40 is in the closed configuration. In the closed configuration, the two pistons 42 on the side of the passages 22 are positioned so as to be on opposite sides of the passages 22. Accordingly, in this closed configuration, liquid is prevented from reaching the interstitial space A, and thus remains in the container body 11. It is observed that the left-hand side piston 42 prevents liquid passage toward the left-hand side opening 21 of the conduit 20. It is also observed that the left-hand side stop member 51 abuts against the periphery of the opening 21, preventing further movement of the valve 40 toward the right-hand side in FIG. 4, hence ensuring that the pistons 42 are properly aligned with the passages 22.

In FIG. 5, the valve 40 is in the dispensing configuration. In the dispensing configuration, the two pistons 42 on the side of the passages 22 are positioned so as to be left of the passages 22. Accordingly, in this dispensing configuration, liquid may reach the interstitial space A via the passages 22. It is observed that both left-hand side pistons 42 prevent liquid passage toward the left-hand opening 21 of the conduit 20. It is also observed that both right-hand side pistons 42 prevent liquid passage toward the right-hand opening 21 of the conduit 20, ensuring that liquid in the interstitial space A of the conduit 20 is dispensed via the spout 18. It is also observed that the right-hand side stop member 51 abuts against the periphery of the opening 21, preventing further movement of the valve 40 toward the left-hand side in FIG. 5, hence ensuring that the pistons 42 are properly aligned with the opening tube 19 of the spout 18. In a variant, there is a single piston 42 on the right-hand side of the valve 40, instead of a pair, as a single piston 42 may be sufficient to seal the right-hand side opening 21 of the conduit 20, although the symmetry of the valve 40 simplifies the reinsertion of the valve 40 after repair—no specific orientation required. In yet another variant, a single piston 42 is large enough to block the passages 22 in the conduit 20. It would therefore be possible to operate a dispensing configuration and a closed position with only a pair of pistons 42. While the above description of the dispensing and closed configurations refer to left- and right-hand side, it should be understood that these references are for ease of understanding, and that the movement could be from fore to aft, reverse, etc, depending on the orientation of the valve 40 relative to a viewer.

The user, by applying pressure on the stop member 51 of the stopper 50 positioned at the tip of the valve 40, can thus push the valve 40 through the cylindrical conduit 20 on its longitudinal axis until the stop member 51 abuts the periphery of the opening of the conduit 20. This movement is reciprocal, as the valve 40 may be shifted in the opposite direction, this movement being delimited by the other stop member 51. It is also considered that the outermost pistons 42 on the valve 40 reach the end of the cylindrical conduit 20, to help preventing further movement by the sealing effect of the O-ring 44 on the piston 42 at the entrance of the cylindrical conduit 20. Therefore, the reciprocal movement allows the user to shift the valve 40 between closed and dispensing configurations. From an ergonomical standpoint, it is possible for the user to perform this reciprocal movement with the same hand that is holding the sport bottle 10. Indeed, the user 10 may hold the bottle by its container body 11, using his/her palm and middle finger, ring finger and little finger, with the index finger on one end of the valve 40 (e.g., stopper 50), and the thumb on the other end of the valve 40 (e.g., other stopper 50). The index finger and thumb may apply sufficient force to perform the reciprocal movements between the closed and dispensing configurations.

The valve 40 thus acts as a flow control member by which the pistons 42 in the two distinct configurations either restrict or allow the flow of liquid to the user through the interstitial space A. Such movement of the valve 40 will define the closed and dispensing configuration based on the relative position of the pistons 42 on the valve 40 to the passages 22 in the cylindrical conduit 20.

In the closed configuration, the valve 40 prevents the passage of liquid from the container body 12 to the interstitial space A of the conduit 20.

The dispensing configuration is thus defined in that no sets of pistons 42 disrupt the flow of liquid from the container body 11 through the interstitial space A and into the opening tube 19 of the spout 18. The liquid is thus directed straight to the user and is contained within the confines of the container body 11 through the combined effect of the tapped connector 13 and threaded connector 15 and the restraining effect of the innermost pistons 42 defining the interstitial space A with the conduit A. While multiple inner spaces can be defined with various configurations of openings and pistons, the preferred embodiment contemplates one set of passages 22 defined by two pistons 42.

The foregoing description and the illustrative embodiments of the present invention have been described in detail in varying modifications and alternate embodiments. It should be understood, however, that the foregoing description of the present invention is exemplary only, and that the scope of the present invention is to be limited to the claims as interpreted in view of the prior art. Moreover, the invention illustratively disclosed herein suitably maybe practiced in the absence of any element which is not specifically disclosed herein.

The invention claimed is:

1. A sport bottle comprising:

a liquid container body defining a cavity with top open end, the cavity adapted to contain a liquid;

a cap releasably connected to the container body to close the cavity, said cap having a body with a spout extending outwardly from the body, a conduit extending transversely through the cap and opened on opposed sides of a circumference of the body of the cap, the conduit being in fluid communication with the spout and having at least one passage in fluid communication with the cavity of the liquid container body; and a valve formed of at least two pistons disposed onto a shaft, said valve inserted into the conduit with ends of the valve projecting out of the opposite sides of the circumference of the body, the pistons being sized to sealingly define with the conduit an interstitial space, the valve displaceable by pressing the ends between a closed configuration in which the pistons block the liquid from the cavity from entering the interstitial space in the conduit, and a dispensing configuration in which the interstitial space is aligned with the at least one passage and the spout to allow the liquid from the cavity to enter the interstitial space in the conduit and reach the spout.

2. The sport bottle according to claim 1, wherein the pistons are positioned symmetrically on the shaft so as to make the shaft reversible.

3. The sport bottle according to claim 1, further comprising stoppers at the ends of the shaft, with one of the stoppers abutting against the circumference of the body in the dispensing configuration, and with the other of the stoppers abutting against the circumference of the body in the closed configuration.

4. The sport bottle according to claim 3, wherein the stoppers are removably mounted to the ends of the shaft by snap-fit configuration.

5. The sport bottle according to claim 3, wherein the stoppers each have a flange that comes into abutment with the circumference.

6. The sport bottle according to claim 3, wherein the stoppers are made of a resilient material.

7. The sport bottle according to claim 1, wherein the spout comprises an opening tube integral with the cap, and a removable drink tip.

8. The sport bottle according to claim 7, wherein the drink tip is made of a resilient material connected to the opening tube by snap-fit configuration.

9. The sport bottle according to claim 1, wherein each said piston comprises a groove in its circumference, and a seal received in the groove.

10. The sport bottle according to claim 1, comprising four of said pistons, with a first pair of pistons on opposite sides of the at least one passage in the closed configuration.

11. The sport bottle according to claim 1, comprises a plurality of said passages circumferentially disposed in the conduit.

12. The sport bottle according to claim 1, wherein the body of the cap comprises a base of cylindrical shape, a tapering portion atop the base, and a panel atop the tapering portion.

13. The sport bottle according to claim 12, wherein the conduit has opposite openings in the tapering portion.

14. The sport bottle according to claim 12, wherein the spout projects upwardly from the panel.

15. The sport bottle according to claim 1, wherein the spout is concentrically located in the cap, and the at least one passage is offset relative to the spout.

* * * * *